United States Patent [19]

Marschner et al.

[11] 4,278,436

[45] Jul. 14, 1981

[54] DYEING PROCESS

[75] Inventors: Werner Marschner; Heinz Minwegen, both of Leverkusen, Fed. Rep. of Germany

[73] Assignee: Bayer Aktiengesellschaft, Leverkusen, Fed. Rep. of Germany

[21] Appl. No.: 17,951

[22] Filed: Mar. 6, 1979

[30] Foreign Application Priority Data

Mar. 7, 1978 [DE] Fed. Rep. of Germany ..... 2809675

[51] Int. Cl.[3] ..... C09B 62/00; D06P 3/66

[52] U.S. Cl. ..... 8/549; 8/532; 8/585; 8/602; 8/918

[58] Field of Search ..... 8/1 D, 1 G, 54.2, 85 B, 8/181, 194, 85 R, 549, 532, 585, 602, 918, 638

[56] References Cited

U.S. PATENT DOCUMENTS

| | | | |
|---|---|---|---|
| 2,440,330 | 4/1948 | Dreyfus | 8/40 |
| 2,530,261 | 11/1950 | Morton et al. | 8/182 |
| 3,363,972 | 1/1968 | Ulrich et al. | 8/10 |
| 3,380,799 | 4/1968 | Elizer et al. | 8/115.6 |
| 3,418,063 | 12/1968 | Ulrich et al. | 8/532 |
| 3,535,308 | 10/1970 | Schaefer et al. | 8/120 |
| 4,073,617 | 2/1978 | Le Blanc et al. | 8/184 |
| 4,111,648 | 9/1978 | McConnell et al. | 8/181 |
| 4,134,722 | 1/1979 | Swidler et al. | 8/54.2 |

*Primary Examiner*—A. Lionel Clingman

*Attorney, Agent, or Firm*—Sprung, Felfe, Horn, Lynch & Kramer

[57] ABSTRACT

Process for dyeing and printing cellulose fibre materials with reactive dyestuffs having a halogen leaving group or sulphonyl leaving group on a heterocyclic radical, characterized in that the process is carried out in the presence of a cyanamide or an unsaturated amide in a weakly acid to neutral medium.

8 Claims, No Drawings

DYEING PROCESS

The present invention relates to a process for dyeing and printing cellulose fibres with reactive dyestuffs having a halogen leaving group or sulphonyl leaving group on a heterocyclic radical, which is characterised in that the process is carried out in the presence of a cyanamide or an unsaturated amide in a weakly acid to neutral medium.

The process is particularly suitable for dyeing and printing polyester/cellulose fibre mixed fabrics with mixtures of disperse and reactive dyestuffs of the type mentioned. Such a process is preferably carried out in one bath in one stage, in particular in the absence of alkalis, such as are customarily used for the purpose of fixing the reactive dyestuffs.

The dyeing by the process according to the invention is carried out by a method in which the mixed materials contained polyester fibres and cellulose fibres are impregnated with the appropriate padding liquor (weakly-acid neutral) in the customary manner. The liquor pick-up is between about 40% and 80%, depending on the nature of the material. The material is then intermediately dried at 100°–150° C. and subjected to the thermosol process, that is to say aftertreated with heat, using dry heat or superheated steam conditions, at 170°–220° C. for about 30–90 seconds or 4–6 minutes respectively. The dyeings thus produced are then rinsed and soaped at the boil.

For printing, the printing pastes are prepared using the thickeners customary for disperse and reactive dyestuffs, such as alginates. The dyestuffs are fixed on the printed textile materials by after-treatment with heat using moist heat, for example with saturated steam at 101° to 107° C. or superheated steam at 165° to 200° C., or using dry heat, for example hot air at 180° to 210° C. Materials which can be used are, in particular, mixtures of polyethylene terephthalate and natural or regenerated cellulose.

The padding liquors or printing pastes can furthermore contain further customary auxiliaries—with the exception of alkalis and compounds which supply alkali—for example thickeners, wetting agents and dispersing agents.

Examples of suitable cyanamides are cyanamide, $C_1$–$C_6$-alkyl-substituted cyanamide, dicyandiamide and $C_1$–$C_6$-alkyl-substituted dicyandiamide.

Examples of suitable unsaturated amides are acrylamide, methacrylamide and acrylic acid monoalkylamides and dialkylamides and methacrylic acid monoalkylamides and dialkylamides, in particular those with $C_1$–$C_6$-alkyl groups. Dicyandiamide is preferred.

In general, the amides are employed in amounts of 10 g to 60 g per liter of padding liquor or kg of printing paste. The pH values of the padding liquors or printing pastes are in general about 3–7, in particular ~6.5.

Suitable reactive dyestuffs are, in particular, those with a halogeno-1,3,5-triazine, halogeno-1,3-diazine and 2,3-dihalogenoquinoxaline-6-carbonyl or -6-sulphonyl radical or an alkylsulphonyl- or arylsulphonyl-pyrimidyl radical, such as are described in large numbers in the literature (compare, for example, DT-OS (German Published Specifications) Nos. 1,186,160, 1,544,499 and 1,228,013 and Venkataraman: The Chemistry of Synthetic Dyes, Volume III, Reactive Dyes; Academic Press, New York, London 1972.

The process is very particularly suitable for dyestuffs with a fluoropyrimidine radical, in particular a 2,4-difluoro-5-chloro-pyrimid-6-yl radical, for example those of DT-OS (German Published Specification) No. 1,644,171, and for dyestuffs with a fluoro-1,3,5-triazine radical, for example those of DT-OS (German Published Specifications) Nos. 2,556,640, 1,644,208, 1,644,617 and 1,644,616.

In principle, all the known types of disperse dyestuffs can be used.

EXAMPLE 1

A 65:35 mixed polyester/cotton fabric is padded with the following liquor: 920 g of water, 1 g of octyl phosphate, 10 g of a customary thickener (aqueous polyacrylate solution), 30 g of dicyandiamide, 4 g of the reactive dyestuff of the formula

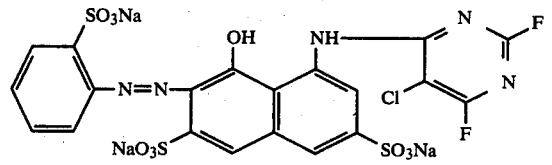

12 g of the reactive dyestuff of the formula

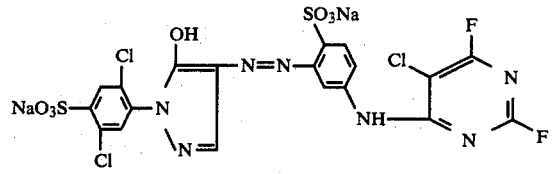

3 g of the disperse dyestuff of the formula

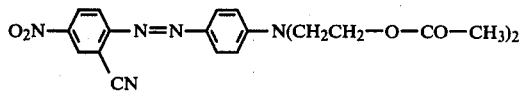

and 20 g of the disperse dyestuff of the formula

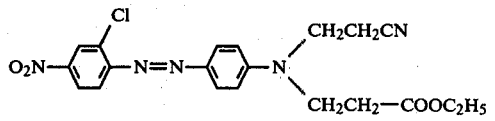

After squeezing off to a liquor pick-up of 50%, the material is dried at 130° C. for 1 minute and the dyestuff is fixed under dry conditions at 220° C. for 1 minute. An orange-coloured dyeing with good fastness properties is obtained.

Dyeings of similar quality are obtained when 7 g of the disperse dyestuff of the formula

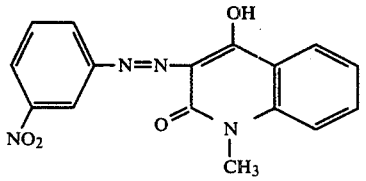

plus 4 g of the reactive dyestuff of the formula

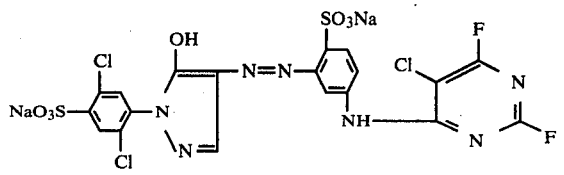

are used, or when 5 g of the disperse dyestuff of the formula

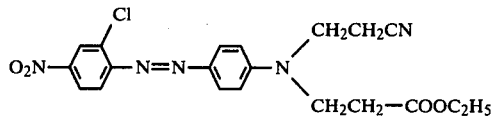

plus 30 g of the disperse dyestuff of the formula

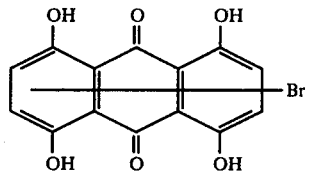

plus 4 g of the reactive dyestuff of the formula

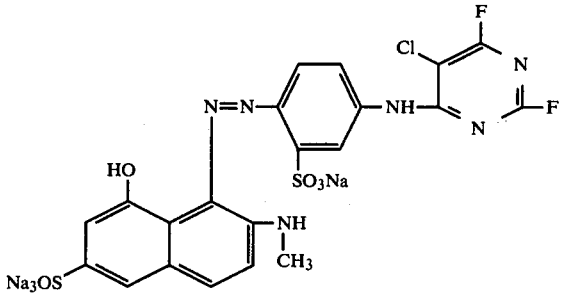

plus 22 g of the reactive dyestuff of the formula

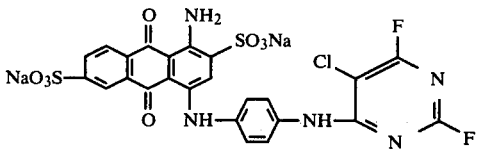

are used, and when 35 g of dicyandiamide are used instead of 30 g.

EXAMPLE 2

A mixed polyester/cotton fabric is printed with a printing paste of the following composition: 390 g of water, 10 g of sodium m-nitrobenzenesulphonate, 50 g of dicyandiamide, 500 g of a customary aqueous thickener (Dialgin HV, 4% strength), 50 g of the disperse dyestuff of the formula

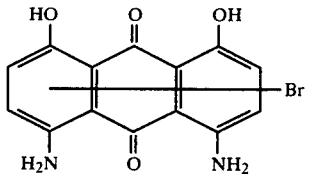

and 50 g of the reactive dyestuff of the formula

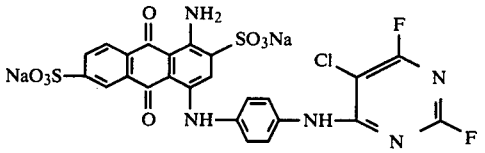

After drying at 100° C., the material is treated with saturated steam at 101°-109° C. for 5 minutes. It is then rinsed in the customary manner, soaped at the boil, rinsed and dried. A blue print with a high colour yield is obtained.

We claim:

1. Process for dyeing and printing cellulose fibre materials with reactive dyestuffs having a halogen leaving group or sulphonyl leaving group on a heterocyclic radical, characterised in that the process is carried out in the presence of a cyanamide of an unsaturated amide in a weakly acid to neutral medium.

2. Process according to claim 1, characterised in that a polyester/cellulose fiber mixed fabric is dyed or printed with mixtures of reactive and disperse dyestuffs.

3. Process according to claim 1, characterised in that it is carried out in one bath in one stage.

4. Process according to claim 1, characterised in that it is carried out at pH values of 3-7.

5. Process according to claim 1, characterised in that 10-60 g of a cyanamide or unsaturated amide/l of padding liquor or printing paste are employed.

6. Process according to claims 1, 2, 3, 4 or 5, characterised in that dicyandiamide is used.

7. A process of claim 4 characterized in that it is carried out at a pH about 6.5.

8. A process of claims 4 or 7 characterized in that it is carried out in the absence of fixing agents, for the reactive dyestuffs, which have an alkaline reaction.

* * * * *